United States Patent [19]

Strickland

[11] Patent Number: 4,664,300

[45] Date of Patent: May 12, 1987

[54] COVER ASSEMBLY FOR SPRAY CANS

[76] Inventor: Jim O. Strickland, 5440 N. Ocean Dr., Suite 1102, Riviera Beach, Fla. 33404

[21] Appl. No.: 850,509

[22] Filed: Apr. 10, 1986

[51] Int. Cl.[4] ..... B65D 83/14

[52] U.S. Cl. ..... 222/402.13; 222/530

[58] Field of Search ..... 222/402.13, 530, 538, 222/192

[56] References Cited

U.S. PATENT DOCUMENTS

| | | | |
|---|---|---|---|
| 2,770,399 | 11/1956 | Gross | 222/530 X |
| 2,789,734 | 4/1957 | Biederman | 222/530 X |
| 3,137,417 | 6/1964 | Zetterstrom | 222/530 X |
| 3,221,950 | 12/1965 | O'Donnell | 222/402.13 X |
| 4,096,974 | 6/1978 | Haber et al. | 222/402.13 |
| 4,305,528 | 12/1981 | Craig | 222/530 X |

FOREIGN PATENT DOCUMENTS

| | | | |
|---|---|---|---|
| 8402056 | 2/1985 | Netherlands | 222/402.13 |

*Primary Examiner*—Joseph J. Rolla
*Assistant Examiner*—Frederick R. Handren
*Attorney, Agent, or Firm*—Jack N. McCarthy

[57] ABSTRACT

A cover assembly for an aerosol-type spray can includes a cup-like shaped cover having a manually movable actuating member slidable therein; said actuating member directing a pressurized fluid to a flexible nozzle tube; said tube being supported by a metal spring around it. A hook on said cover permits said metal spring and flexible nozzle tube to be bent downwardly and held in a stored position.

6 Claims, 9 Drawing Figures

COVER ASSEMBLY FOR SPRAY CANS

TECHNICAL FIELD

This invention relates generally to aerosol-type spray cans having upper standard actuator valves therein which are operable by depressing an actuating member to discharge a spray and more particularly to an improved cover assembly having a flexible nozzle tube supported by a metal spring.

BACKGROUND ART

Aerosol-type spray cans are used universally and incorporate a gas under pressure for ejecting the fluid contents of the can in the form of a spray. Many fluids have been used, including paints and lubricants.

Some aerosol-type spray cans sold today, particularly those containing a lubricating fluid, provide a small separate flexible plastic tube normally held to the exterior of the can by a rubber band or adhesive tape. This flexible tube is formed to be manually inserted in the outlet of the actuating member which is connected to the standard actuator valve within the aerosol-type spray can. When the actuating member is pressed so as to release the pressurized fluid, it will be directed to and confined by the flexible tube. This arrangement is such that places which are difficult to reach can be sprayed by the insertion of the flexible tube. With the flexible tube held to the aerosol can merely by a rubber band or scotch tape when the can is purchased, it can become easily separated and lost. Further, once the separate flexible tube has been used, it can be laid aside and easily mislaid or lost. This background is discussed in U.S. Pat. No. 4,096,974. Other patents showing flexible tubes and holding devices are U.S. Pat. Nos. 2,789,734; 3,653,556; and 4,236,655.

SUMMARY OF THE INVENTION

An object of the invention is to provide a cover assembly for aerosol-type spray cans having a cover which can be fixed to the spray can having a cylindrical actuating member at the center thereof for engaging the outlet of a standard actuator valve in said spray can, said cylindrical actuating member having a passage for directing the pressurized fluid therethrough to an outlet, and a flexible tube having one end fixed to said outlet of said passage in said cylindrical actuating member for applying said fluid to a desired area, a metal spring positioned around said flexible tube for supporting it and having one end fixed to said cylindrical actuating member.

Another object of this invention is to provide a cover assembly for aerosol-type spray cans having a hook projecting from the side of said cover below said flexible tube and metal spring for permitting said flexible tube and metal spring to be bent downwardly from their substantially radial operating position to a downwardly projecting stored position where the metal spring contacts the interior of the hook; upon release of the metal spring from the hook the flexible tube and metal spring return to their substantially radial operating position.

A further object of this invention is to provide a cylindrical actuating member having a passage therethrough having an inlet and outlet, said inlet cooperating with the outlet of said standard actuator valve in said spray can for operating said standard actuator valve, and said outlet having a countersunk portion for receiving a flexible tube and outer coaxial metal spring attached thereto.

Another object of this invention is to have a recess in the cover to permit one's finger to easily press the cylindrical actuating member, an opening in the cover for said flexible tube and metal spring to pass therethrough, and a hook projecting from the side of said cover under said opening for placing said flexible tube and metal spring in a stored position.

BEST MODE FOR CARRYING OUT THE INVENTION

Figure 3:
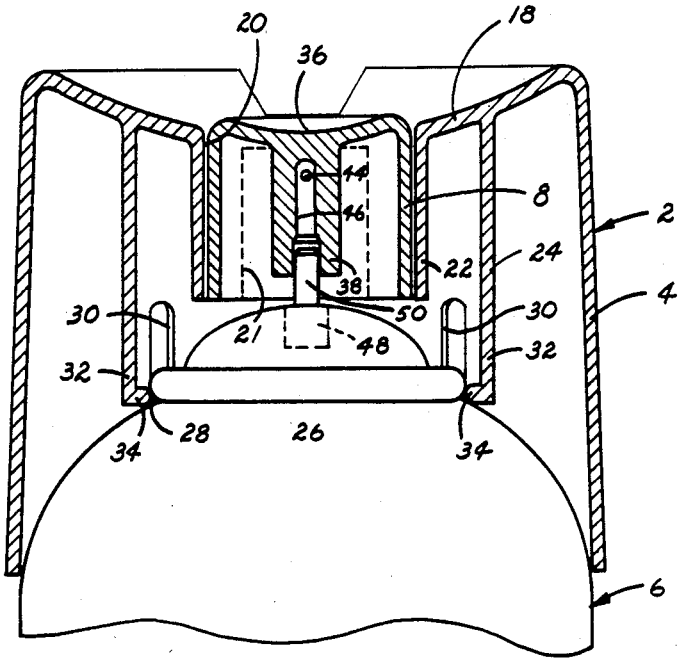
FIG. 3 is a rear view of the cover assembly fixed on an aerosol-type spray can with the cover assembly being shown in cross-section.
Figure 4:
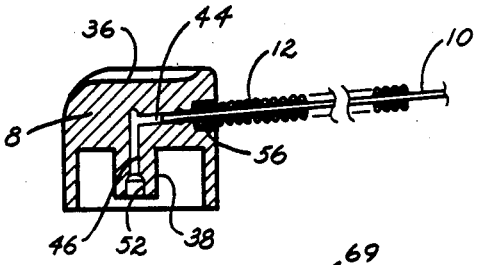
FIG. 4 is a view of the cylindrical actuating member of the cover assembly with the attached flexible nozzle tube and metal spring.
Figure 5:
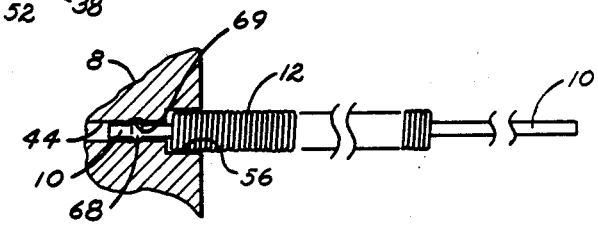
FIG. 5 is an enlarged view of the attachment of the flexible nozzle tube and metal spring to the cylindrical actuating member.

Referring to FIG. 3, a cover assembly 2 having an outer cup-like shape 4 is placed over the top of a conventional aerosol-type spray can 6 and fixed thereto. The cover assembly 6 comprises five (5) main parts:

(1) a cup-like shaped outer cover 4;
(2) a center movable cylindrical actuating member 8;
(3) a flexible nozzle tube 10 connected to actuating member 8;
(4) a closely wound metal spring 12 connected to actuating member 8 around said nozzle tube 10; and
(5) a hook 16 extending from the side of said outer cover 4.

In assembly, there are two sub-assemblies which are movable, with respect to each other. A first sub-assembly is the cover 4 with attached hook 16 and the second sub-assembly is the center cylindrical actuating member 8 with cooperating flexible nozzle tube 10 and metal spring 12 fixed thereto.

The top 18 of the cover 4 is concave and has an opening 20 at the center thereof with a short cylindrical flange 22 extending downwardly therefrom for receiving the center cylindrical actuating member 8. A second cylindrical flange 24 extends downwardly between short cylindrical flange 22 and the interior of the side of the cover 4 a distance greater than flange 22 to engage a ring member 26 on the top of aerosol-type spray can 6. Ring member 26 provides a projecting annular ridge 28, and the lower part of the second cylindrical flange 24 has three slots 30 forming three short arms 32 each having an inwardly projecting lip 34 for engaging the annular ridge 28. This snap connection fixes the cover 4 to the aerosol-type spray can 6.

The aerosol-type spray can 6 shown in FIG. 3 is the well known type having a standard actuator valve 48 therein (represented schematically) with a short outlet tube 50 extending upwardly therefrom, said standard actuator valve 48 and short outlet tube 50 being biased upwardly to a closed position and movement of said tube 50 downwardly a short fixed distance opens the standard actuator valve 48 and permits fluid contents in the spray can 6 to pass out the short outlet tube 50 under pressure.

Figure 6:
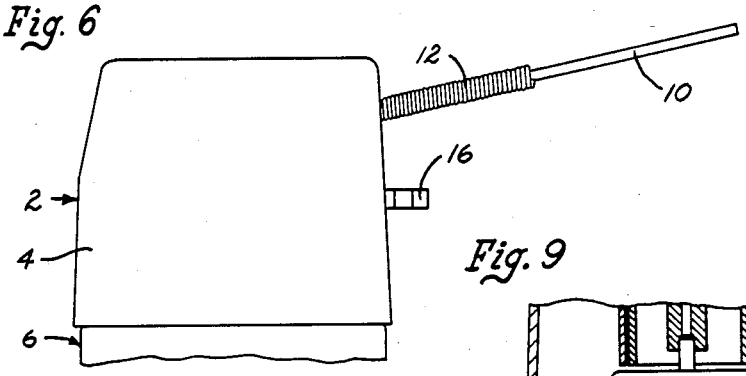
FIG. 6 is a side view of the cover assembly on an aerosol-type spray can with the flexible nozzle tube and metal spring in operating position.
Figure 7:
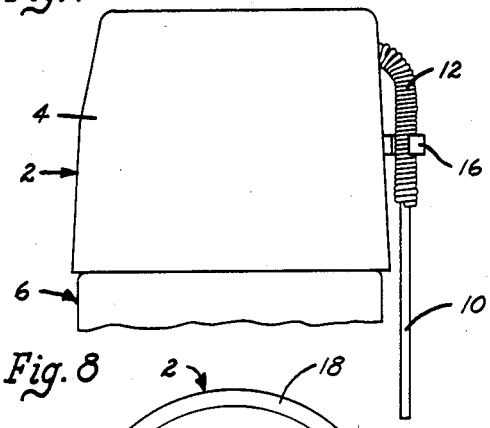
FIG. 7 is a side view of the cover assembly on an aerosol-type spray can shown in FIG. 6 with the flexible nozzle tube and metal spring bent downwardly to a stored position where the metal spring contacts the interior of the hook.
Figure 8:
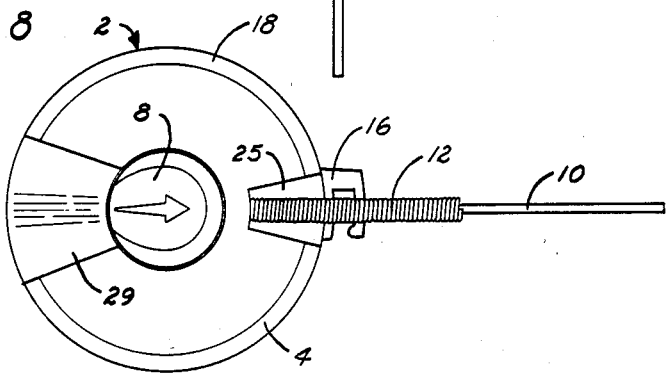
FIG. 8 is a top view of the cover assembly shown in FIG. 6.

The short cylindrical flange 22 has a longitudinal section removed from the bottom of the flange 22 towards the top 18 of the cover 4, forming an opening 21 towards the front of the cover 4. An opening 23 is formed in the second cylindrical flange 24 aligned with the center of opening 21. A channel 25 is formed between the opening 23 in cylindrical flange 24 and a larger aligned cut out portion 27 in the forward part of cover 4. The opening 21, opening 23, and cut out portion 27 provide a pathway for the insertion of the flexible nozzle tube 10 and metal spring 12 of the second sub-assembly, so they can project out of cover 4 as shown in FIGS. 6, 7 and 8. A large channel 29 is formed in the top 18 and upper end of cover 4 to receive the finger of an operator. A hook 16 extends from the front of the cover 4 below the location of the channel 25.

The cylindrical actuating member 8 of the second sub-assembly comprises a cylindrical member having a contoured top 36 to receive the tip of an operator's finger. A coaxial cylindrical member 38 extends downwardly from the interior of the top 36. A rib 40 connects the cylindrical member 38 to the rear of the cylindrical actuating member 8 for support and a larger contoured rib 42 connects the cylindrical member 38 to the front of the cylindrical actuating member 8 for support and location of a radial passage 44 therein for connection with an axial passage 46 in cylindrical member 38 extending inwardly from the end thereof.

Passage 44 intersects the inner end of passage 46 within said cylindrical actuating member 8 to form a continuous passage therethrough, the inlet being formed at the free end of the cylindrical member 38 and the outlet being formed on the side of the cylindrical actuating member 8 indicating the front of the cover assembly 2 when assembled.

The inlet of passage 46 is countersunk at 52 to snugly receive the end of the short outlet tube 50 of the aerosol-type spray can 6. It can be seen that movement of cylindrical actuating member 8 downwardly will direct pressurized fluid from short outlet tube 50 into passage 46.

The outlet of connecting passage 44 is formed having a countersunk portion 56 to fixedly engage one end of the closely wound metal spring 12. The closely wound metal spring 12 snugly engages the countersunk portion 56 of passage 44 in cylindrical actuating member 8 to hold it in place. Other known holding means can be used. The flexible nozzle tube 10 in said closely wound metal spring 12 has a small annular radial projection 68 at its end for engaging a small radial annular groove 69 in the inner surface of connecting passage 44 adjacent the bottom of countersunk portion 56. When the flexible nozzle tube 10 is pressed into the passage 44 at the bottom of the countersunk portion 56, it snaps in place to prevent it from being accidentally removed.

Figure 1:
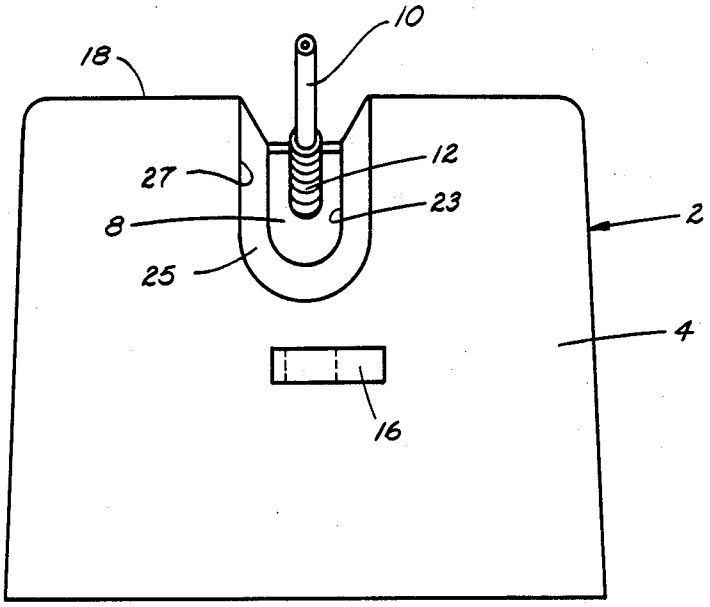
FIG. 1 is a front view of the cover assembly.
Figure 2:
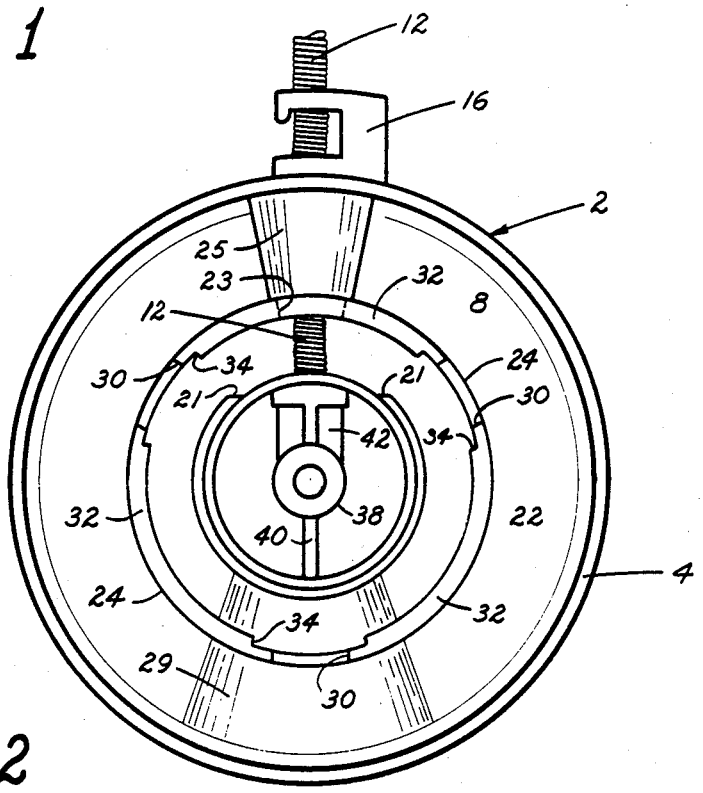
FIG. 2 is a bottom view of the cover assembly shown in FIG. 1.

When the first and second sub-assemblies are assembled as shown in FIGS. 1, 2 and 3 and fixed on an aerosol-type spray can, it can be seen that when cylindrical actuating member 8 is pressed downwardly, the pressurized fluid in the aerosol-type spray can 6 is directed through short outlet tube 50 into the inlet of passage 46, the fluid then passes radially through passage 44 to the flexible nozzle tube 10 for delivery to a desired location, metal spring 12 properly positioning the flexible tube 10 as shown in FIG. 6. When not in use, the flexible nozzle tube 10 and metal spring 12 are bent downwardly to a stored position with the metal spring 12 positioned in the hook 16 (see FIG. 7).

In a cover assembly built, the flexible nozzle tube 10 was made of plastic and the metal spring 12 was made of stainless steel. The metal spring 12 must extend to at least engage the hook 16 when bent for its stored position.

Figure 9:
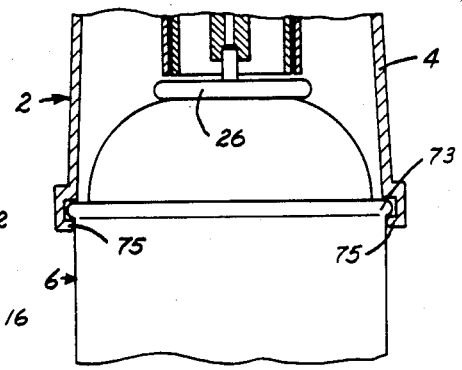
FIG. 9 is a side view of a modified cover assembly where the lower edge of the cover is contoured to snap over the outer edge of a can having a radially projecting rim at its outer edge.

FIG. 9 shows a modification of the means for fixing the cover 4 on an aerosol-type can of different construction. With a rim 73 at the top of the circumference of the can, the lower edge of the cover 4 can have projections 75 to snap over the rim. Other known fixing means can be used.

While an aerosol-type spray can 6 is shown having a short outlet tube 50 extending therefrom, the type of spray can and upper actuator valve disclosed in U.S. Pat. No. 4,096,974 can be used. With this type spray can, the cylindrical member 38 of cylindrical actuating member 8 can be made to extend downwardly further and be sized to enter a valve opening to actuate the valve.

I claim:

1. A cover assembly for a spray can containing a fluid under pressure, comprising a cover having a cup-like shape with a movable actuating portion mounted for reciprocable motion, said movable actuating portion having a passage therethrough, said passage having an inlet and an outlet, said inlet being contoured to contact a spray can and release fluid under pressure into said inlet, a flexible nozzle tube, a metal spring, said metal spring being located around said flexible nozzle tube, means fixing one end of said flexible nozzle tube to said movable actuating portion for connection with said outlet and fixing one end of said metal spring to said movable actuating portion, said flexible nozzle tube and metal spring extending through said cover to the exterior thereof, a hook extending from the exterior side of said cover below the outlet of said movable actuating portion, said metal spring and flexible nozzle tube being movable between a position projecting unsupported from said movable actuating portion and a position bent downwardly with said metal spring held by said hook.

2. A combination as set forth in claim 1 wherein said cover has means for fixing it to a spray can, said cover having opening means for said flexible nozzle tube and said metal spring to pass therethrough.

3. A combination as set forth in claim 2 wherein said means for fixing said cover to a spray can is a downwardly extending cylindrical flange, said cylindrical flange having slots forming spring fingers at its free end.

4. A combination as set forth in claim 1 wherein said metal spring extends from said movable actuating portion a distance to just extend past said hook when said metal spring and flexible nozzle tube are bent downwardly.

5. A cover assembly for an aerosol-type spray can, comprising a cover having a cup-like shape, a movable actuating member in said cover, an opening in said cover for manually moving said movable member, said movable member having an inlet and an outlet for directing a flow therethrough, a flexible nozzle tube and tightly wound metal spring, means connecting one end of said flexible nozzle tube to said outlet of said movable member, said metal spring being located around said flexible nozzle tube, means fixing one end of said metal spring to said movable member for supporting said flexible nozzle tube in an operating position, said flexible nozzle tube and said metal spring extending through said cover to the exterior thereof, and a hook on the exterior side of said cover below said flexible nozzle tube and metal spring for receiving said metal spring and holding said metal spring and flexible nozzle tube in a downwardly stored position.

6. A cover assembly for spray cans where the spray can includes an upper valve therein having a short outlet tube extending upwardly therefrom, means biasing said upper valve to a closed position, movement of said small tube downwardly opens said valve and permits contents in the can to discharge under pressure through said short outlet tube; including a cover positioned over said short outlet tube and fixed to said spray can, a cylindrical wall extending downwardly from the top of said cover, a cylindrical actuating member positioned in said cylindrical wall for slidable movement therein, said cylindrical member having a passage with an inlet for receiving the upper end of said short outlet tube, said passage having an outlet to one side, a flexible plastic nozzle tube, means fixing one end of said flexible plastic nozzle tube to said cylindrical actuating member for connection to said outlet, opening means in said cover, said flexible plastic tube extending through said opening means to the exterior of said cover a short distance to direct the spray to a hard-to-reach place, a metal spring positioned around said flexible plastic tube and fixed to said cylindrical actuating member, a hook extending from the exterior side of said cover below said flexible plastic tube, said flexible plastic tube and said metal spring being bendable so as to be bent downwardly and positioned in said hook in a stored position.

* * * * *